US008556578B1

(12) United States Patent
Memmen et al.

(10) Patent No.: US 8,556,578 B1
(45) Date of Patent: Oct. 15, 2013

(54) SPRING LOADED COMPLIANT SEAL FOR HIGH TEMPERATURE USE

(75) Inventors: Robert L Memmen, Stuart, FL (US); John A Fedock, Port St. Lucie, FL (US); James P Downs, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/585,891

(22) Filed: Aug. 15, 2012

(51) Int. Cl.
*F01D 5/18* (2006.01)

(52) U.S. Cl.
USPC ..... 415/135; 277/644

(58) Field of Classification Search
USPC ..... 415/135, 138, 139; 416/96 A, 97 R; 277/530, 566, 641, 643, 644, 647, 648
See application file for complete search history.

(56) References Cited

U.S. PATENT DOCUMENTS

| | | | | | |
|---|---|---|---|---|---|
| 3,612,551 | A * | 10/1971 | Grabill, Jr. | ..... | 277/566 |
| 4,477,086 | A * | 10/1984 | Feder et al. | ..... | 277/632 |
| 5,265,890 | A * | 11/1993 | Balsells | ..... | 277/467 |
| 5,865,600 | A * | 2/1999 | Mori et al. | ..... | 416/198 A |
| 6,193,240 | B1 * | 2/2001 | Johnson et al. | ..... | 277/643 |
| 6,318,732 | B1 * | 11/2001 | Hoyes et al. | ..... | 277/593 |
| 6,431,825 | B1 * | 8/2002 | McLean | ..... | 415/135 |
| 6,857,849 | B2 * | 2/2005 | Hirst | ..... | 415/135 |
| 7,316,402 | B2 * | 1/2008 | Paauwe | ..... | 277/641 |
| 7,744,096 | B2 * | 6/2010 | Kono | ..... | 277/644 |
| 7,901,186 | B2 * | 3/2011 | Cornett et al. | ..... | 416/198 A |
| 2009/0072497 | A1 * | 3/2009 | Kunitake et al. | ..... | 277/641 |
| 2011/0020137 | A1 * | 1/2011 | Wilson et al. | ..... | 416/97 R |
| 2011/0079966 | A1 * | 4/2011 | Fleury et al. | ..... | 277/648 |
| 2013/0028713 | A1 * | 1/2013 | Giri et al. | ..... | 415/135 |

* cited by examiner

*Primary Examiner* — Edward Look
*Assistant Examiner* — Aaron R Eastman
(74) *Attorney, Agent, or Firm* — John Ryznic

(57) ABSTRACT

A flexible seal having an X-shaped cross section that forms four contact points on four contact surfaces of two opposed seal slots. The flexible seal is used for a component in which the two seal slots undergo a large deflection such that the opposed slots are not aligned and a rigid seal will not form an adequate seal. The flexible seal can be used in a component of a combustor or a turbine in a gas turbine engine where opposed seal slots undergo the large deflection during operation.

17 Claims, 3 Drawing Sheets

SPRING LOADED COMPLIANT SEAL FOR HIGH TEMPERATURE USE

GOVERNMENT LICENSE RIGHTS

This invention was made with Government support under contract number DE-FE-0006696 awarded by Department of Energy. The Government has certain rights in the invention.

CROSS-REFERENCE TO RELATED APPLICATIONS

None.

BACKGROUND OF THE INVENTION

1. Field of the Invention

The present invention relates generally to a gas turbine engine, and more specifically to a seal between opposing slots that suffer from relative movement.

2. Description of the Related Art including information disclosed under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

In order to increase the gas stream temperature, a spar and shell blade and vane design has been proposed. A spar and shell blade or vane includes a separate shell having an airfoil shape that is secured to a spar that functions as a support structure and a cooling air supply channel to the shell. Because the shell is a separate piece, it can be made from a different material such as a refractory material that has a higher melting temperature than the standard nickel super alloys currently used for cast blades and vanes.

In a gas turbine engine, the combustor and the turbine both have surfaces that must include a seal to prevent the hot gas from leaking through. These surfaces include combustor transition ducts, inter-segment gaps for blade outer air seals or duct segments, platform interfaces of turbine vanes, case-tied compressor stator vane segments, and seals between a spar and a shell in a spar and shell stator vane or rotor blade. Because these sealing surfaces are exposed to high temperatures, the opposing slots that receive the seal have a larger relative movement that results in the prior art seals to produce high leakages. The prior art seals are too rigid and not flexible enough in order to maintain a seal surface with the slots due to this high relative movement between the adjacent seal slots.

BRIEF SUMMARY OF THE INVENTION

A flexible seal having an X-shape with four ends that fit with opposed seal slots that have a large amount of displacement. The flexible seal can be used in a high temperature environment such as in a combustor or a turbine of a gas turbine engine to provide for adequate sealing even with displacement of one seal slot in relation to an opposed seal slot.

In one embodiment, the flexible seal is formed from two outwardly curved seal sections bonded together around a middle section that has an X-shape. In other embodiments, a third member is positioned between the two outwardly curved sections and is either free from or bonded to the two curved sections.

DETAILED DESCRIPTION OF THE INVENTION

The present invention is a flexible or compliant seal that is used in a high temperature environment (such as that in a combustor or a turbine of a gas turbine engine) in which the two opposed seal slots in which the compliant seal is located is not aligned so that prior art rigid seals do not produce adequate sealing. The flexible seal of the present invention will provide a high sealing capability as the opposed two seal slots move with respect to one another. The compliant seal can be used on surfaces such as a combustor transition duct inter-segment gaps for blade outer air seals or duct segments, platform interfaces of turbine vanes, case-tied compressor stator vane segments, and seals between a spar and a shell in a spar and shell stator vane or rotor blade.

Figure 1:
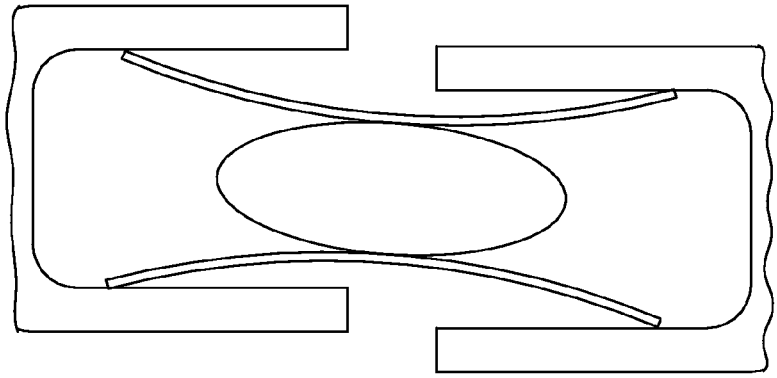
FIG. 1 shows a cross section view of a compliant seal of the present invention in two adjacent seal slots that are offset.
Figure 2:
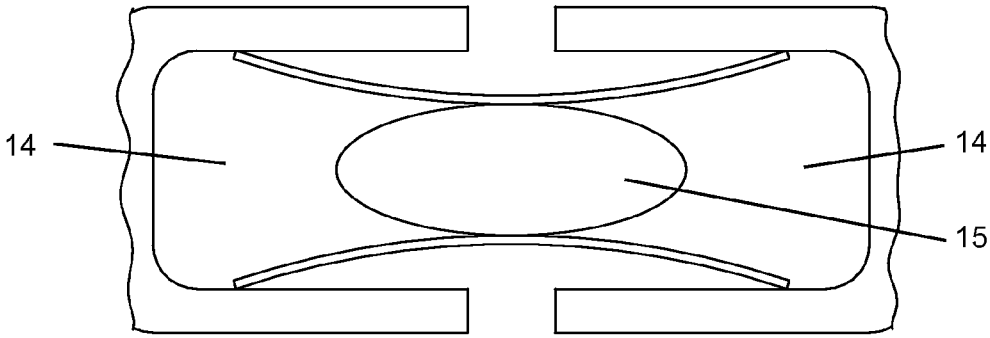
FIG. 2 shows a cross section view of a compliant seal of the present invention in two adjacent slots that are in line and not offset.
Figure 3:
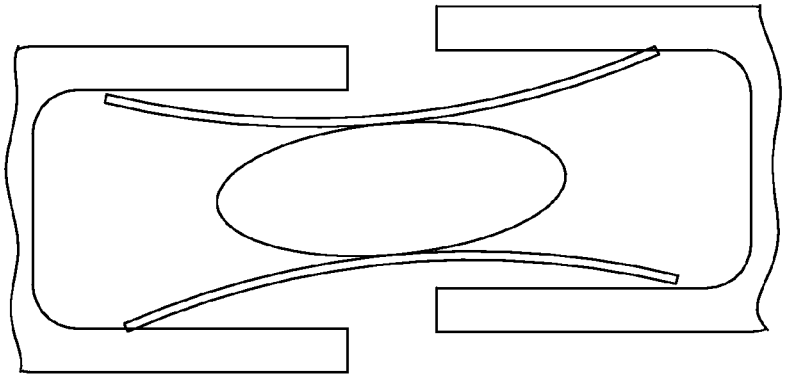
FIG. 3 shows a cross section view of a compliant seal of the present invention in two adjacent seal slots that are offset opposite to that in FIG. 1.

FIGS. 1 through 3 shows the flexible or compliant seal 15 of the present invention in opposed seal slots 14 with different alignments of the slots 14. FIG. 2 shows the slots 14 is alignment while FIG. 1 shows the slot 14 on the left side raised above the slot on the right side. FIG. 3 shows the opposite of FIG. 1 misalignment. Because of the design of the compliant seal 15 of the present invention, the seal 15 produces proper seal contact with the four surfaces formed within the two opposed seal slots.

The X-shaped compliant seal 15 of the present invention is a spring activated seal that can be used to seal between any two parts that have a groove or slot in each part, such as between turbine vane platforms, blade outer air seal segments, between combustor transition ducts, and between case-tied compressor stator vane segments. This self-activated flexible spring seal 15 has the advantage of being insensitive to profile tolerance and distortion of the mating parts. The flexible spring seal 15 is also resistant to vibratory wear caused by excitation combustor acoustics and from blade passing. The flexible spring seal 15 has less leakage than a single layer seal, because it has two sealing lines of contact in series.

Another benefit to the flexible seal of the present invention is that the two opposed seal slots 14 do not have to have a high tolerance as is required with the rigid seals of the prior art. In the rigid seals of the prior art, the seal slot surfaces would require machining in order to form seal surfaces with low tolerances. In the flexible seal of the present invention, the seal slots can be cast without requiring any machining after casting and still form adequate sealing because of the flexibility of the flexible seal 15.

Figure 4:
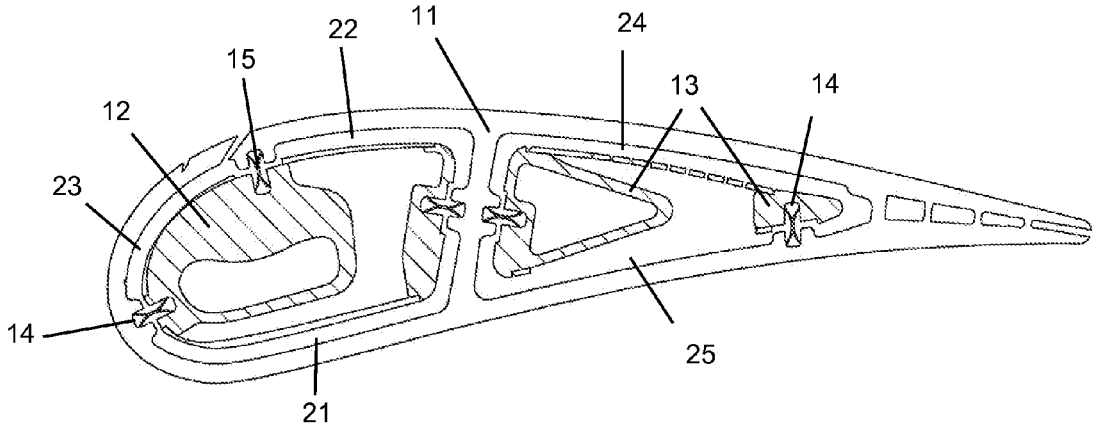
FIG. 4 shows a cross section top view of a spar and shell stator vane with radial seals separating different cooling zones.

FIG. 4 shows the compliant seal of the present invention used in a high temperature turbine stator vane of the spar and shell construction having different zones of cooling in which a series of impingement cooling occurs around the shell. FIG. 4 shows a cross section view of the spar and shell vane with a shell 11 having leading edge region and a trailing edge region with pressure side and suction side walls extending between the edges, and with a single rib extending from the pressure side wall to the suction side wall to form a forward region and an aft region for cooling. A forward insert 12 occupies a space in the forward region of the shell 11 and an aft insert 13 occupies the space in the aft region of the shell 11. Each insert is secured within the hollow spaces within the airfoil and is secured to a top side of the vane and free floating on the bottom side to allow for thermal growth between the vane airfoil and the inserts. Both the forward insert 12 and the aft insert 13 form a series of impingement cooling channels that provide cooling for the entire regions of the shell. The series of impingement cooling channels are separated into different cooling zones by radial extending high temperature compliant seals 15 as seen in FIG. 4.

The shell 11 and the two inserts 12 and 13 have radial extending seal slots 14 formed within in which the radial extending seals 15 are placed. In the embodiment of FIG. 4, three radial seals 15 are used to form and separate three cooling zones with one cooling zone 21 located on the pressure side wall in the forward region, and a second and third cooling zone 22 and 23 located on the suction side wall in the forward region. In the aft region, two radial seals 15 form and separate two cooling zones with one cooling zone 24 located on the suction side wall and the other cooling zone 25 located on the pressure side wall in the aft region of the shell.

In the forward region of the vane, the cooling circuit is a sequential impingement cooling circuit in which a first impingement cooling occurs in the zone 21, and then the cooling air flows to and impinges in the second zone 22, and then is collected and flows to and impinges in the third zone 23 all in series. Because of this series of impingement cooling, the zones must be sealed from one another so that the pressurized cooling air does not flow around the seals. The cooling zones must be separated around the airfoil. An ineffective seal would allow for the cooling air to migrate over and pollute the adjacent zone cooling air flow.

All prior art seals will not work in the spar and shell vane with the sequential impingement cooling inserts of the present invention because the cool spar relative to the hot shell results in relative movement in the axial and radial directions which causes the seals to leak. A small differential pressure between zones eliminates the use of a feather seal.

The various seals of the present invention shown in FIGS. 5 through 9 produce a high level of sealing between the cool inserts and the hot shell that will allow for a large relative movement while maintaining the seal to prevent cross migration of the cooling air between zones. The seal must fit into a short space and allow the seal to yield at installation. A highly yielding seal will allow for higher manufacturing tolerances in the seal slots 14. In fact, the radial slots 14 in the shell and the insert can be formed in the casting process of each part in which no additional machining is required. Thus, the cost is lowered.

The seals are four point seals in which two points on one end make contact with the radial slot in the shell while two points on the other end make contact with the radial slot on the insert. These four points of contact allow for a large amount of relative movement of the slots while still maintaining contact with the slot surfaces to seal the zones. The four point seal is flexible and short to allow for easy installation in the short slot spaces.

Figure 5:
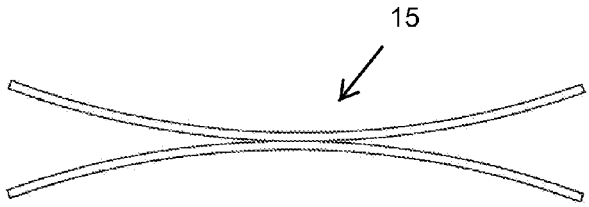
FIG. 5 shows a cross section side view of a first embodiment of high temperature compliant seal used in the spar and shell vane of the present invention.

FIG. 5 shows a first embodiment of the seal 15 in which this X seal is fabricated from a nickel-cobalt-chromium alloy material such as INCONEL X-750 of 0.008 inches thick. The seal 15 is 6.8 mm wide and fits into 3 mm slots in the shell and insert. The vane assembly in this embodiment uses five radial seals 15 each 7.5 inches in length. The two halves of the seal 15 are brazed together in the center. In another embodiment, the two halves could be free and not brazed or secured together. If the slot 14 in the shell moves relative to the slot in the insert in the chordwise plane of the vane, the flexible seal 15 will still make contact on the four points with the slot surfaces because of the flexibility of the seal 15.

Figure 6:
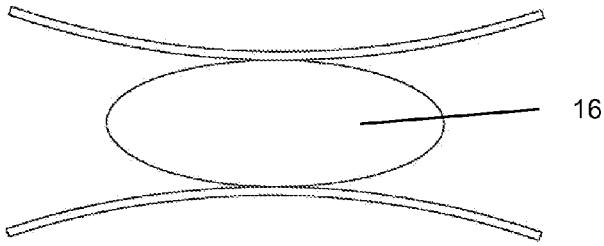
FIG. 6 shows a cross section side view of a second embodiment of high temperature compliant seal used in the spar and shell vane of the present invention.
Figure 7:
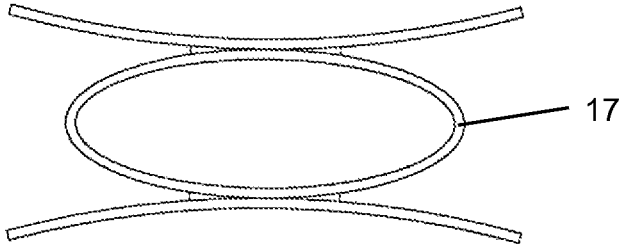
FIG. 7 shows a cross section side view of a third embodiment of high temperature compliant seal used in the spar and shell vane of the present invention.
Figure 8:
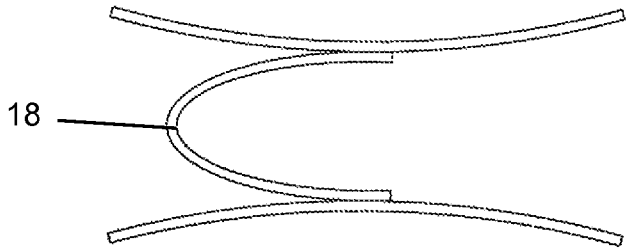
FIG. 8 shows a cross section side view of a fourth embodiment of high temperature compliant seal used in the spar and shell vane of the present invention.
Figure 9:
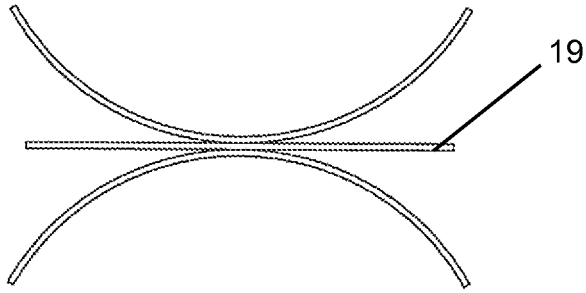
FIG. 9 shows a cross section side view of a fifth embodiment of high temperature compliant seal used in the spar and shell vane of the present invention.

The flexible seal 15 in FIG. 6 in which the two seal halves are separated by a NEXTEL rope or wire braid 16. The flexible seal in FIG. 7 is separated by a hollow coach spring 17 which includes a hollow egg-shaped flexible member. The flexible seal in FIG. 8 is separated by a C-shaped helper spring 18. The flexible seal in FIG. 9 is separated by a flat shim 19 that is not joined to the two halve springs. The flexible seal in the FIG. 9 embodiment can be inserted easily into the seal slots 14 and then the shim 19 inserted after to produce a bias on the four points or ends of the two half springs. In the FIGS. 5 through 9 embodiments, the two spring halves are bonded to the middle or intermediate piece to form a seal from three pieces. However, the two spring halves do not need to be bonded in order to work effectively.

The two outward curved seal halves are connected together through a brazed or bonded surfaces without any intermediate third piece or through making contact without any braze or bond, or through a third intermediate piece such as those shown in FIGS. 6 through 9.

In testing, the flexible radial seals of the present invention produce a much better seal in the adjacent slots that are displaced from one another than any of the prior art more rigid seals used. The flexible seal 15 of the present invention seals at least four times better than any prior art rigid seal tested.

We claim the following:

1. A flexible seal comprising:

a first seal slot;

a second seal slot opposed to the first seal slot and forming a gap between the two seal slots;

a flexible seal secured within the two seal slots;

the flexible seal having a first outward curved seal half and a second outward curved seal half;

the two outward curved seal halves form four seal contact surfaces to make contact with four surfaces of the two seal slots; and, a spacer positioned between the first and second outward curved seal halves.

2. The flexible seal of claim 1, and further comprising:

the spacer is a rope or wire braid is positioned between the two seal halves.

3. The flexible seal of claim 1, and further comprising:

the spacer is a hollow spacer positioned between the two seal halves.

4. The flexible seal of claim 1, and further comprising:

the spacer is a C-shaped helper spring is positioned between the two seal halves.

5. The flexible seal of claim 1, and further comprising:

the spacer is a flat shim is positioned between the two seal halves.

6. The flexible seal of claim 5, and further comprising:

the flat shim is not bonded to either of the two seal halves.

7. The flexible seal of claim 1, and further comprising:

the two seal halves form an X-shaped seal.

8. The flexible seal of claim 1, and further comprising:

the flexible seal is fabricated from a nickel-cobalt-chromium alloy material.

9. The flexible seal of claim 8, and further comprising:

the nickel-cobalt-chromium alloy material has a thickness of about 0.008 inches.

10. A component of a gas turbine engine exposed to a high temperature during operation of the gas turbine engine, the component comprising:

a first seal slot;

a second seal slot opposed to the first seal slot and forming a gap between the two seal slots;

the two seal slots having a large misalignment from exposure to the high temperature during engine operation such that a rigid seal will not maintain an sufficient seal between the two seal slots;

a flexible seal secured within the two seal slots;

the flexible seal having a first outward curved seal half and a second outward curved seal half;

the two outward curved seal halves form four seal contact surfaces to make contact with four surfaces of the two seal slots; and, a spacer positioned between the first and second outward curved seal halves.

11. The component of a gas turbine engine of claim 10, and further comprising:

the component is a turbine vane platforms, or a blade outer air seal segments, or between combustor transition ducts, or between case-tied compressor stator vane segments, or a spar and shell airfoil.

12. The component of a gas turbine engine of claim 11, and further comprising:

the flexible seal is fabricated from a nickel-cobalt-chromium alloy material.

13. The component of a gas turbine engine of claim 12, and further comprising:

the nickel-cobalt-chromium alloy material has a thickness of around about 0.008 inches.

14. A turbine stator vane for a turbine in a gas turbine engine, the stator vane comprising:

a shell having an airfoil shape with a leading edge and a trailing edge and with a pressure side wall and a suction side wall extending between the leading and trailing edges;

an insert secured within the shell;

two opposed radially extending seal slots formed in the shell and the insert;

an X-shaped flexible seal secured within the opposed seal slots;

the X-shaped flexible seal having four ends that form contact surfaces with four surfaces of the two opposed seal slots; and, a spacer positioned between the first and second outward curved seal halves.

15. The turbine stator vane of claim 14, and further comprising:

the X-shaped flexible seal includes a first outward curved seal half and a second outward curved seal half; and, the two outward curved seal halves are joined together between the four ends that form the contact surfaces.

16. The turbine stator vane of claim 14, and further comprising:

the flexible seal is fabricated from a nickel-cobalt-chromium alloy material.

17. The turbine stator vane of claim 16, and further comprising:

the nickel-cobalt-chromium alloy material has a thickness of about 0.008 inches.

* * * * *